US010312620B1

(12) United States Patent
Su

(10) Patent No.: US 10,312,620 B1
(45) Date of Patent: Jun. 4, 2019

(54) SPRING CONNECTOR AND CONNECTING DEVICE

(71) Applicant: NEXTRONICS ENGINEERING CORP., New Taipei (TW)

(72) Inventor: Hou-An Su, Keelung (TW)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 16/122,971

(22) Filed: Sep. 6, 2018

(30) Foreign Application Priority Data

Jun. 6, 2018 (TW) ..... 107119473 A

(51) Int. Cl.
*H01R 13/627* (2006.01)
*H01R 13/187* (2006.01)
*H01R 13/516* (2006.01)
*H01R 13/58* (2006.01)

(52) U.S. Cl.
CPC ..... *H01R 13/187* (2013.01); *H01R 13/516* (2013.01); *H01R 13/5804* (2013.01)

(58) Field of Classification Search
CPC .. H01R 13/6272; H01R 13/6275; H01R 4/01; H01R 17/12; H01R 13/111
USPC ..... 439/352, 161, 353, 357, 675, 851
See application file for complete search history.

(56) References Cited

U.S. PATENT DOCUMENTS

| | | | | |
|---|---|---|---|---|
| 5,062,808 | A * | 11/1991 | Hosler, Sr. | H01R 24/542 439/580 |
| 5,904,599 | A | 5/1999 | Miller | |
| 6,722,705 | B2 * | 4/2004 | Korkor | A61M 39/1011 285/148.6 |
| 8,517,768 | B2 * | 8/2013 | Blaha | H01H 85/0026 337/195 |
| 8,690,595 | B2 * | 4/2014 | Barna | H01H 85/0241 439/352 |
| 9,649,436 | B2 * | 5/2017 | Capone | F04B 49/06 |
| 9,831,598 | B2 * | 11/2017 | Keith | H01R 13/5816 |
| 9,917,394 | B2 * | 3/2018 | Natoli | H01R 13/5213 |
| 2016/0308297 | A1 | 10/2016 | Sato | |

FOREIGN PATENT DOCUMENTS

| | | | |
|---|---|---|---|
| JP | 200425950 | A | 9/2004 |
| TW | 201526418 | A | 7/2015 |
| TW | 1562463 | B | 12/2016 |

* cited by examiner

*Primary Examiner* — Phuong Chi T Nguyen
(74) *Attorney, Agent, or Firm* — Li & Cai Intellectual Property (USA) Office

(57) ABSTRACT

A spring connector includes an insulating case and a plurality of spring terminals. The insulating case includes a plurality of cable slots spaced apart from each other. The spring terminals are disposed on the insulating case, and each of the spring terminals has a contacting portion and a tail portion. The contacting portion of each of the spring terminals is formed in a spiral shape so as to have a gap. The cables are respectively disposed in the cable slots of the insulating case, the cables are respectively arranged in the gaps of the contacting portions of the spring terminals, and each of the cables is sandwiched by the corresponding contacting portion, so that the spring terminals are electrically connected to the cables.

10 Claims, 12 Drawing Sheets

SPRING CONNECTOR AND CONNECTING DEVICE

CROSS-REFERENCE TO RELATED PATENT APPLICATION

This application claims the benefit of priority to Taiwan Patent Application No. 107119473, filed on Jun. 6, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a spring connector and a connecting device, and more particularly to a spring connector and a connecting device each applied to establish connection (e.g., by clamping) with cables having small diameter.

BACKGROUND OF THE DISCLOSURE

A conventional connector is a connecting device to electrically connect to cables, a circuit board, or other circuit components, and has been widely applied to various electronic products around our lives. The conventional connector can be applied to medical equipment, and some of the medical equipment need to be provided with a contact apparatus that, when added with new functions, requires the corresponding connector to be formed with more contacts for transmitting signals from the new functions of the contact apparatus. In order to prevent the size of the connector from getting larger, both the connector and the corresponding cables need to be designed with a smaller size, leading to severed cables and soldering difficulties between terminals of the connector and the cables. Moreover, if the connector is provided with insulation displacement connection (IDC) terminals, the size of the cables would be limited by the IDC terminals, so that cables having small diameter cannot be easily applied therewith.

SUMMARY OF THE DISCLOSURE

In response to the above-referenced technical inadequacies, the present disclosure provides a spring connector and a connecting device to effectively improve the issues associated with conventional connectors (e.g., severed cables and soldering issues).

In one aspect, the present disclosure provides a spring connector for being connected to a cable assembly. The cable assembly includes a plurality of cables each having a connecting end portion. The spring connector includes an insulating case and a plurality of spring terminals. The insulating case includes a plurality of cable slots that are spaced apart from each other. The spring terminals are disposed on the insulating case and each have a contacting portion and at least one tail portion. In each of the spring terminals, the contacting portion is formed in a spiral shape so as to have a gap, and the at least one tail portion is connected to the contacting portion. The contacting portions of the spring terminals are respectively disposed in the cable slots. The connecting end portions of the cables are also respectively disposed in the cable slots of the insulating case, and are respectively arranged in the gaps of the contacting portions of the spring terminals. Each of the connecting end portions is sandwiched by the corresponding contacting portion in a four-point connection, so that the spring terminals are electrically connected to the cables, respectively.

In one aspect, the present disclosure provides a connecting device adapted as a plug connecting device or a socket connecting device. The connecting device includes a housing, a plurality of spring connectors, an electrical connector, a plurality of cable assemblies, and a plurality of circuit boards. The spring connectors are disposed in the housing and are stacked together. Each of the spring connectors includes an insulating case and a plurality of spring terminals. In each of the spring connectors, the insulating case includes a plurality of cable slots spaced apart from each other, and the spring terminals are disposed on the insulating case. Each of the spring terminals has a contacting portion and at least one tail portion, the contacting portion is formed in a spiral shape so as to have a gap, and the at least one tail portion is connected to the contacting portion. The contacting portions of the spring terminals are respectively disposed in the cable slots of the insulating case. The electrical connector is disposed in the housing. The cable assemblies are respectively assembled with the spring connectors, and each of the cable assemblies includes a plurality of cables. Each of the cables has a connecting end portion. In each of the cable assemblies and the corresponding spring connector, the connecting end portions of the cables are respectively disposed in the cable slots of the insulating case, the connecting end portions of the cables are respectively arranged in the gaps of the contacting portions of the spring terminals, and each of the connecting end portions is sandwiched by the corresponding contacting portion in a four-point connection, so that the spring terminals are electrically connected to the cables, respectively. The circuit boards are disposed in the housing. The tail portions of the spring connectors are respectively and electrically connected to the circuit boards, and the circuit boards are electrically connected to the electrical connector, so that the cables of the cable assemblies are electrically connected to the electrical connector through the spring terminals of the spring connectors and the circuit boards.

In certain embodiments, the insulating case of the present disclosure includes a first end surface, a second end surface, an inner periphery surface, and an outer periphery surface, the first end surface and the second end surface being respectively arranged on two opposite surfaces of the insulating case, and the inner periphery surface and the outer periphery surface being respectively located at an inner side and an outer side of the insulating case. Each of the cable slots is recessed in the first end surface, the inner periphery surface, and the outer periphery surface of the insulating case along a radial direction of the insulating case.

Therefore, in the present disclosure, the spring connector includes an insulating case and a plurality of spring terminals, the connecting end portions of the cables are respectively disposed in the cable slots of the insulating case, the connecting end portions of the cables are respectively arranged in the gaps of the contacting portions of the spring terminals, and each of the connecting end portions is sandwiched by the corresponding contacting portion, so that the spring terminals are electrically connected to the cables. Accordingly, the spring connector of the present disclosure can be used to clamp cables with small diameters without causing cable severance or soldering difficulties.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
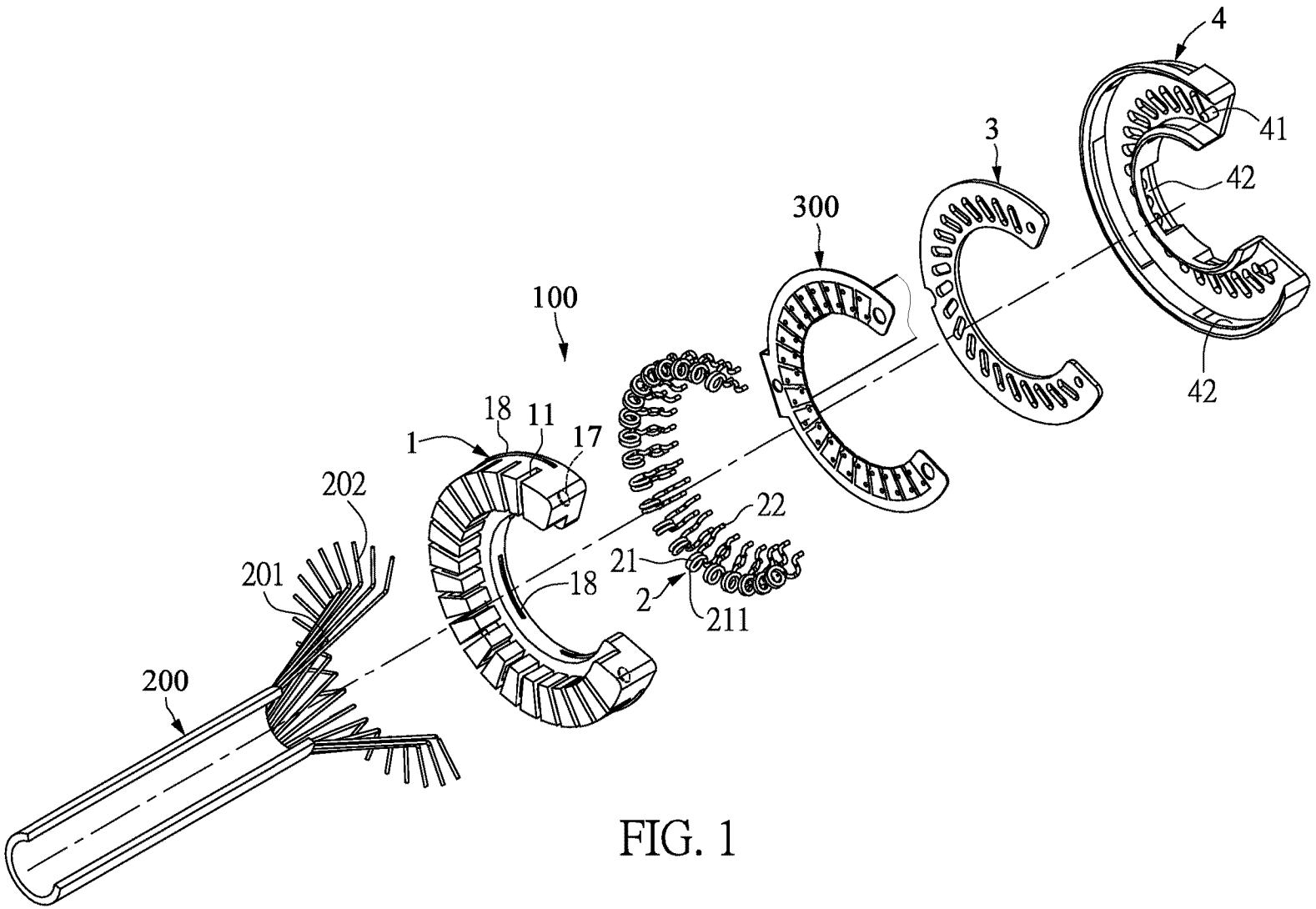
FIG. 1 is an exploded view of a spring connector according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
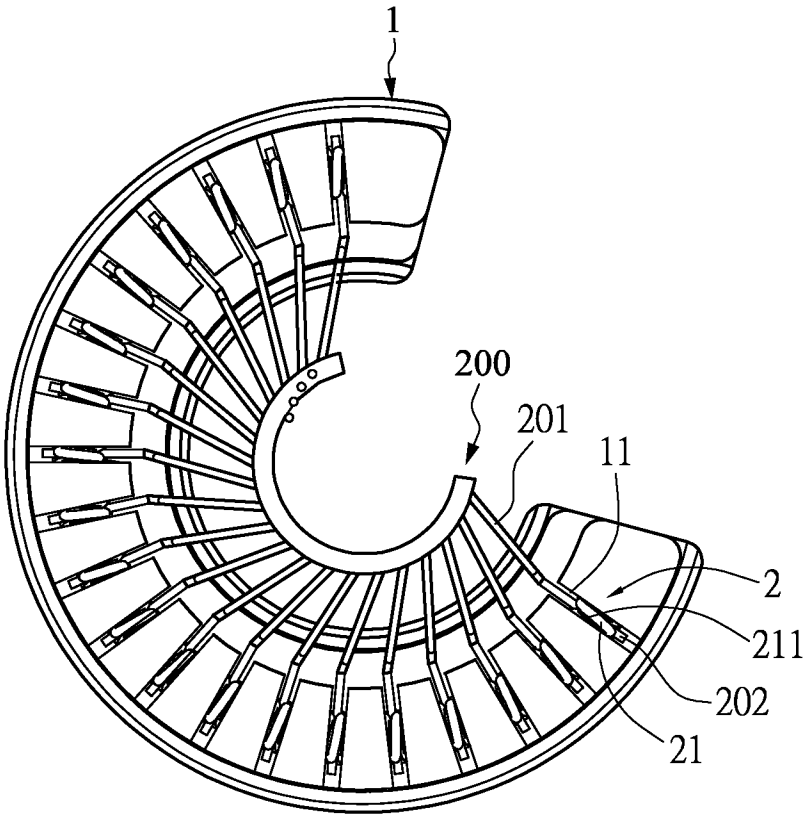
FIG. 2 is a side view of the spring connector according to the first embodiment of the present disclosure.
Figure 3:
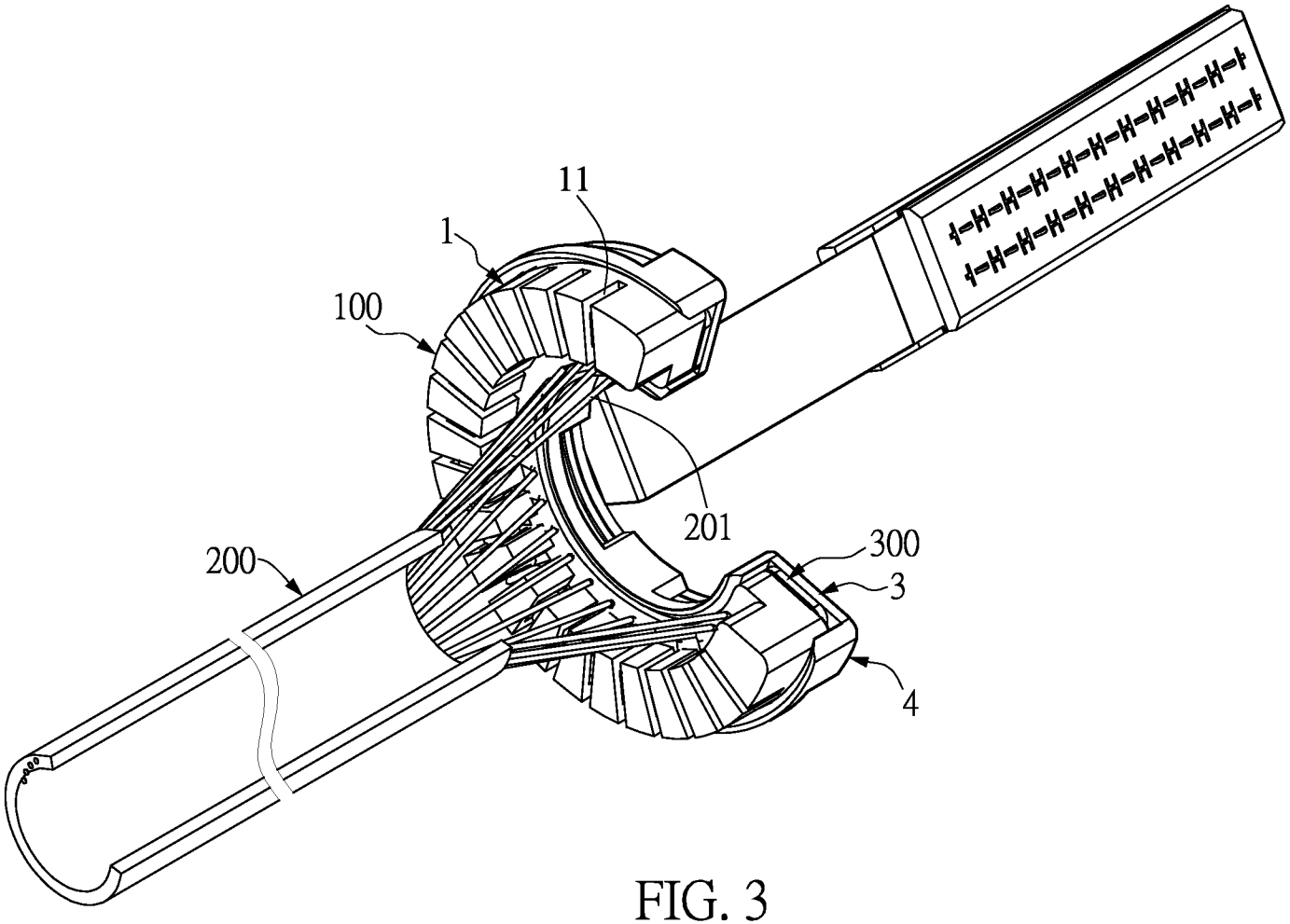
FIG. 3 is a perspective view of the spring connector according to the first embodiment of the present disclosure.

Referring to FIG. 1 to FIG. 6, a first embodiment of the present disclosure provides a spring connector 100. As shown in FIG. 1 to FIG. 3, the spring connector 100 is provided for being disposed in a connecting device. The connecting device can be a plug connecting device or a socket connecting device, but the present disclosure is not limited thereto.

Figure 4:
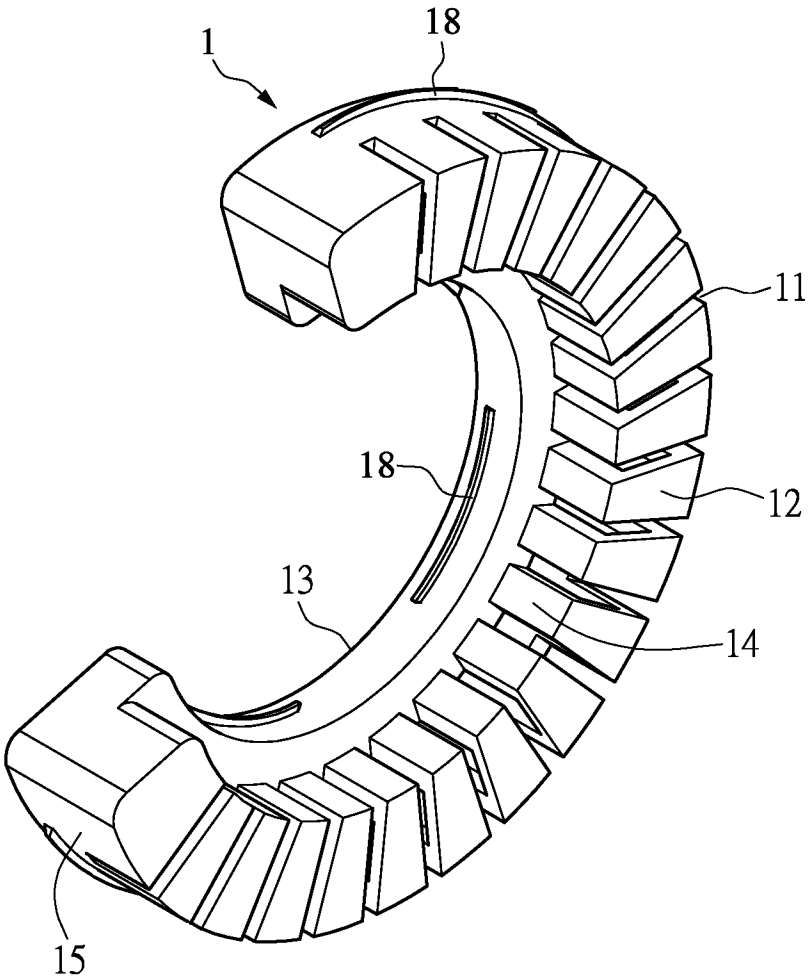
FIG. 4 is a perspective view of an insulating case of the spring connector according to the first embodiment of the present disclosure.
Figure 5:
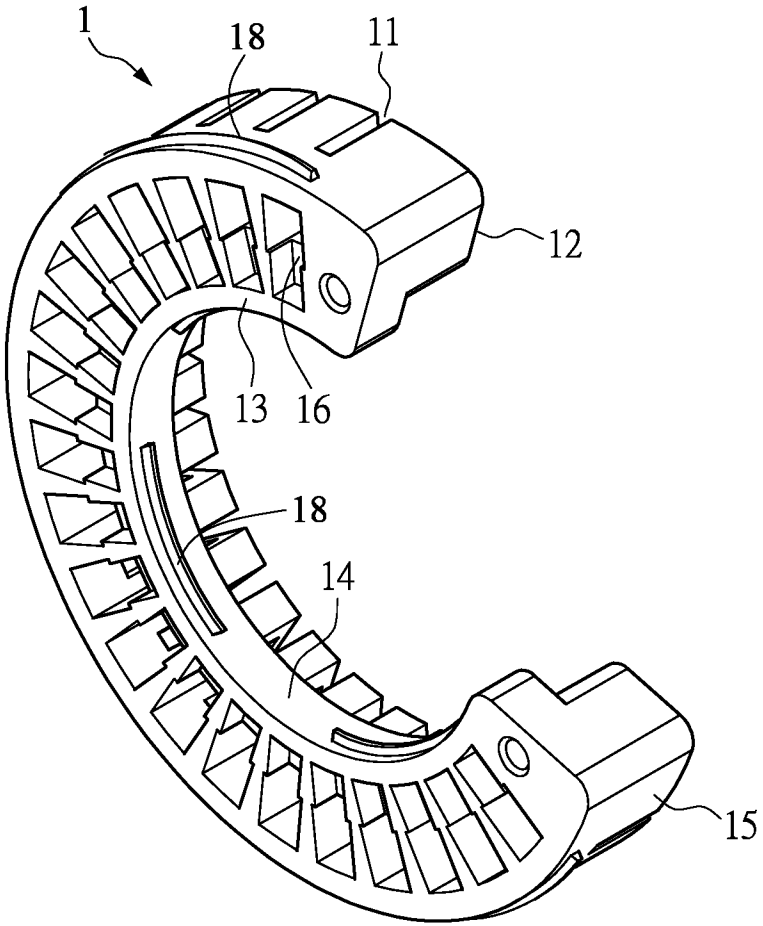
FIG. 5 is a perspective view of the insulating case of the spring connector from another perspective according to the first embodiment of the present disclosure.

The spring connector 100 is configured to be connected to a cable assembly 200. The cable assembly 200 includes a plurality of cables 201 each having a connecting end portion 202. Specifically, the cable 201 includes an inner conductor and an insulator covering the inner conductor. A portion of the insulator arranged on an end of the cable 201 can be removed so as to expose a portion of the inner conductor adjacent thereto, and the exposed portion of the inner conductor in the present embodiment is defined as the connecting end portion 202. A diameter of the connecting end portion 202 can be less than or equal to 0.1 mm, but the present disclosure is not limited thereto. The spring connector 100 includes an insulating case 1 and a plurality of spring terminals 2. The insulating case 1 can be made of an insulating material (e.g., plastic), but the material and structure of the insulating case 1 are not limited thereto. In the present embodiment, the insulating case 1 is in a C-shape and has a plurality of cable slots 11 spaced apart from each other. Specifically, the insulating case 1 includes a first end surface 12, a second end surface 13, an inner periphery surface 14, and an outer periphery surface 15 (as shown in FIG. 4 and FIG. 5). The first end surface 12 and the second end surface 13 are respectively arranged on two opposite surfaces of the insulating case 1, and the inner periphery surface 14 and the outer periphery surface 15 are respectively arranged on an inner side and an outer side of the insulating case 1. Each of the cable slots 11 is recessed in the first end surface 12, the inner periphery surface 14, and the outer periphery surface 15 of the insulating case 1 along a radial direction of the insulating case 1, thereby allowing the connecting end portions 202 of the cables 201 to be respectively disposed in the cable slots 11. The radial direction of the insulating case 1 in the present embodiment can be the direction extending from the inner periphery surface 14 toward the outer periphery surface 15. In addition, the insulating case 1 includes a plurality of terminal slots 16 that are spaced apart from each other and that are respectively in spatial communication with the cable slots 11. The terminal slots 16 are recessed in the second end surface 13.

Each of the spring terminals 2 is made of metal or alloy with highly conductive properties. For example, the spring terminal 2 can be made of a phosphorus copper wire, but the present disclosure is not limited thereto. The number of the spring terminals 2 can be adjusted or changed according to design requirements. The spring terminals 2 are disposed on the insulating case 1, and are respectively disposed in the terminal slots 16. Each of the spring terminals 2 is formed by bending a metal wire that has a diameter within a range of 0.1 mm to 0.3 mm, but the present disclosure is not limited thereto.

Each of the spring terminals 2 includes a contacting portion 21 and at least one tail portion 22. In each of the spring terminals 2, the contacting portion 21 is formed in a spiral shape (e.g., the contacting portion 21 is a spiral spring structure) so as to have a gap 211. In each of the spring terminals 2, the at least one tail portion 22 is connected to the contacting portion 21, and the number of the at least one tail portion 22 can be one or two so as to be connected to one end or two ends of the contacting portion 21. The contacting portions 21 of the spring terminals 2 are respectively disposed in the cable slots 11. The tail portions 22 of the spring terminals 2 can be electrically connected to a circuit board 200 or other devices by soldering or other manners. The circuit board 300 in the present embodiment is a flexible circuit board.

The spring connector 100 further includes a cover 3 and a supporting plate 4. Each of the cover 3 and the supporting plate 4 is a C-shaped plate body corresponding in shape to the insulating case 1. The cover 3 is disposed on the second end surface 13 of the insulating case 1 to cover the terminal slots 16, so that the spring terminals 2 can be firmly disposed in the terminal slots 16. The circuit board 300 is configured to be sandwiched between the cover 3 and the insulating case 1, and the supporting plate 4 is disposed on a surface of the cover 3 that is distant from the insulating case 1. The supporting plate 4 can include a plurality of fixing posts 41 passing through the cover 3 and the circuit board 300. The insulating case 1 has a plurality of fixing holes 17, and the fixing posts 41 of the supporting plate 4 are respectively and fixedly engaged in the fixing holes 17 of the insulating case 1, thereby firmly combining the insulating case 1, the circuit board 300, the cover 3, and the supporting plate 4. The insulating case 1 can include a plurality of first engaging portions 18 formed on the inner side and the outer side (e.g., the inner periphery surface 14 and the outer periphery surface 15) thereof. The supporting plate 4 can be a hollow structure, and can include a plurality of second engaging portions 42 formed on an inner side and an outer side thereof. The first engaging portions 18 are respectively and fixedly engaged with the second engaging portions 42, thereby more firmly combining the insulating case 1, the circuit board 300, the cover 3, and the supporting plate 4.

In the present embodiment, the connecting end portions 202 of the cables 201 are respectively disposed in the cable slots 11 of the insulating case 1 and are respectively arranged in the gaps 211 of the contacting portions 21 of the spring terminals 2, and each of the connecting end portions 202 is sandwiched by the corresponding contacting portion 21. Since the contacting portion 21 in the present embodiment is the spiral spring structure having a predetermined elastic force, the contacting portion 21 can firmly clamp the connecting end portion 202 of the corresponding cable 201 so as to establish an electrical connection there-between. Accordingly, the cables 201 are electrically connected to the circuit board 300 through the spring terminals 2. Moreover, the spring connector 100 of the present embodiment can be used to clamp cables with small diameters without severing the cables. In each of the spring connectors 100 of the present disclosure, the insulating case 1 is C-shaped, parts of the cables 201 are in a radial arrangement with respect to a center of circle of the C-shaped insulating case 1 so as to have the same length, and the other parts of the cables 201 pass through the C-shaped insulating case 1, so that the C-shaped insulating cases 1 of the spring connectors 100 can be stacked in one row.

Figure 6:
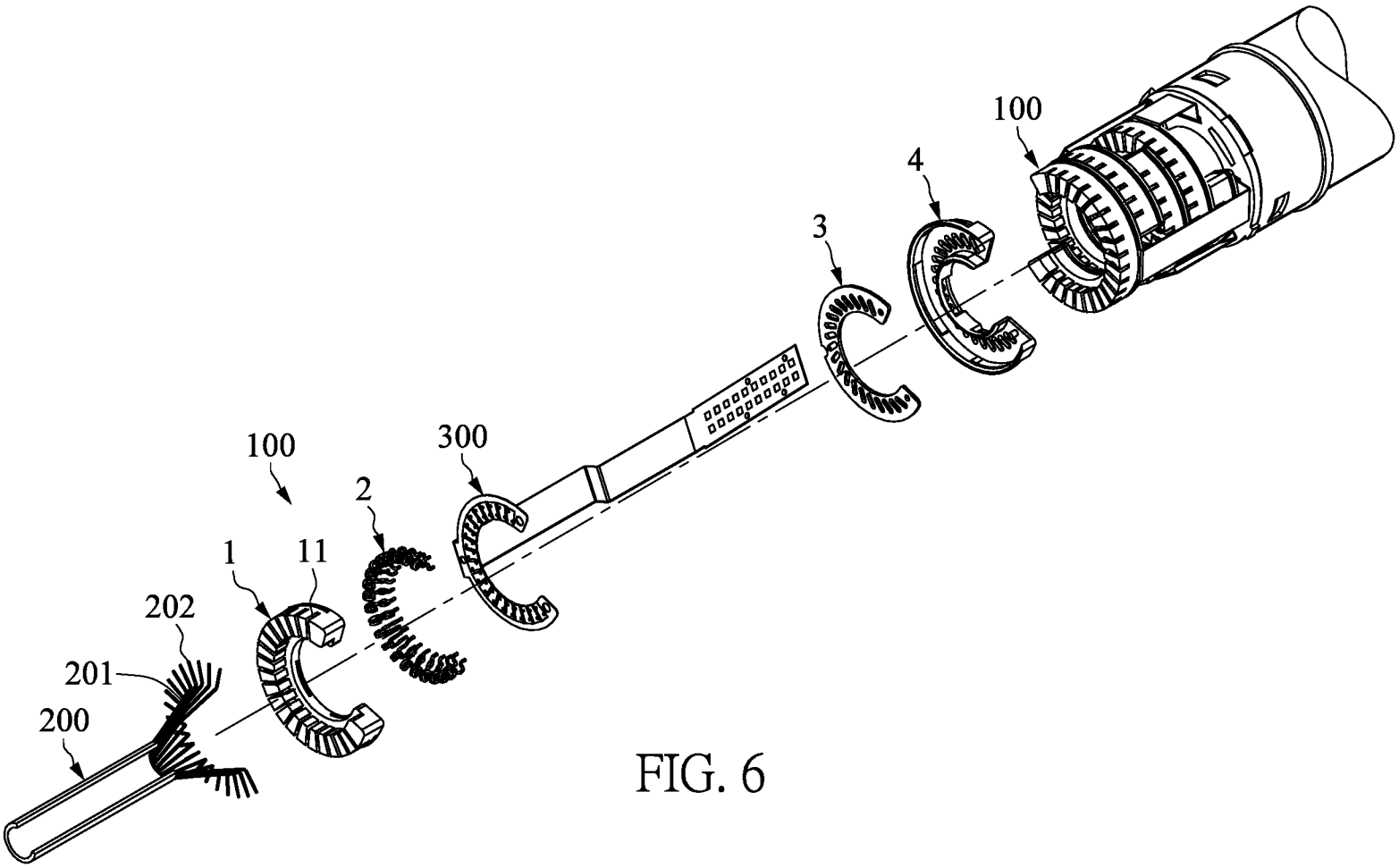
FIG. 6 is a perspective view showing a plurality of the spring connectors stacked together according to the first embodiment of the present disclosure.
Figure 7:
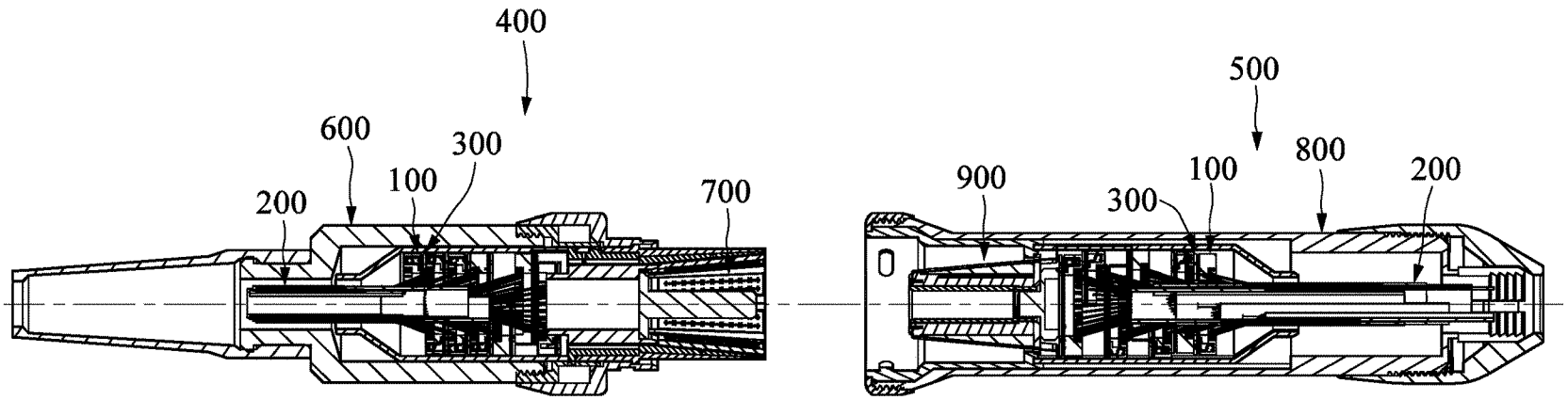
FIG. 7 is a cross-sectional view of a first connecting device and a second connecting device according to a second embodiment of the present disclosure.
Figure 8:
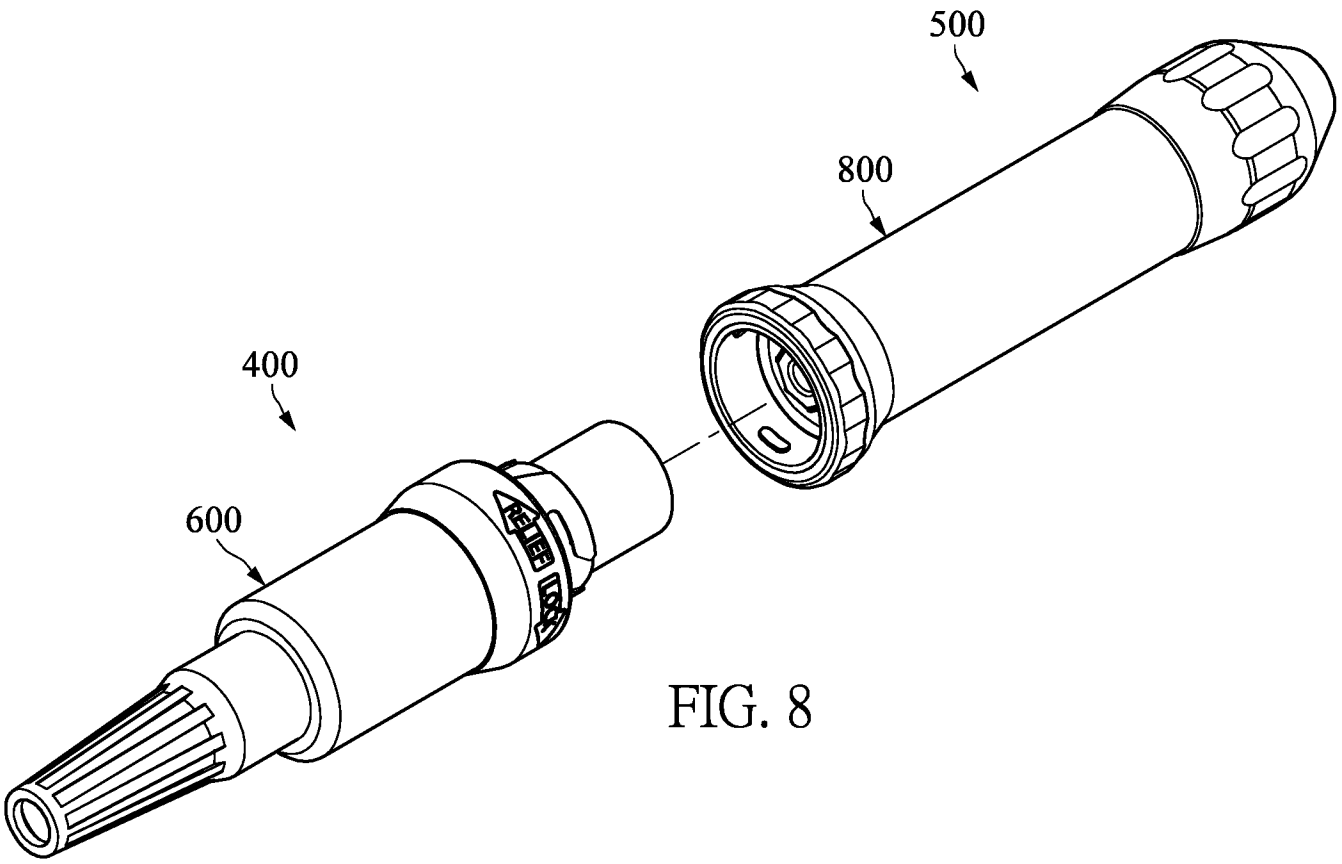
FIG. 8 is a perspective view of the first connecting device and the second connecting device according to the second embodiment of the present disclosure.

As shown in FIG. 6, in actual use of the spring connector 100 of the present disclosure, a plurality of the spring connectors 100 can be stacked together to form a connecting device with high density contacts.

Figure 11:
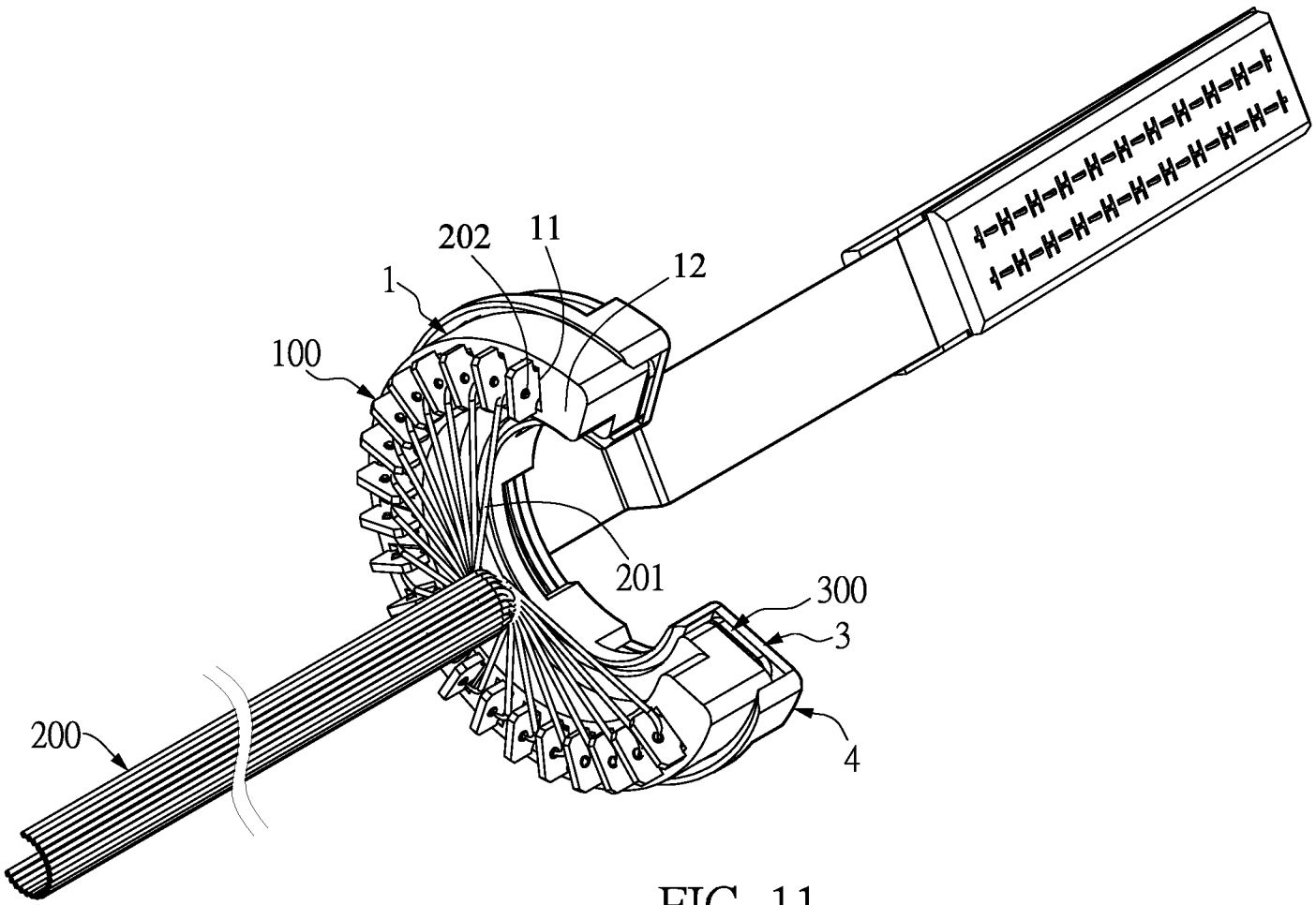
FIG. 11 is a perspective view of the spring connector in another configuration according to the present disclosure.
Figure 12:
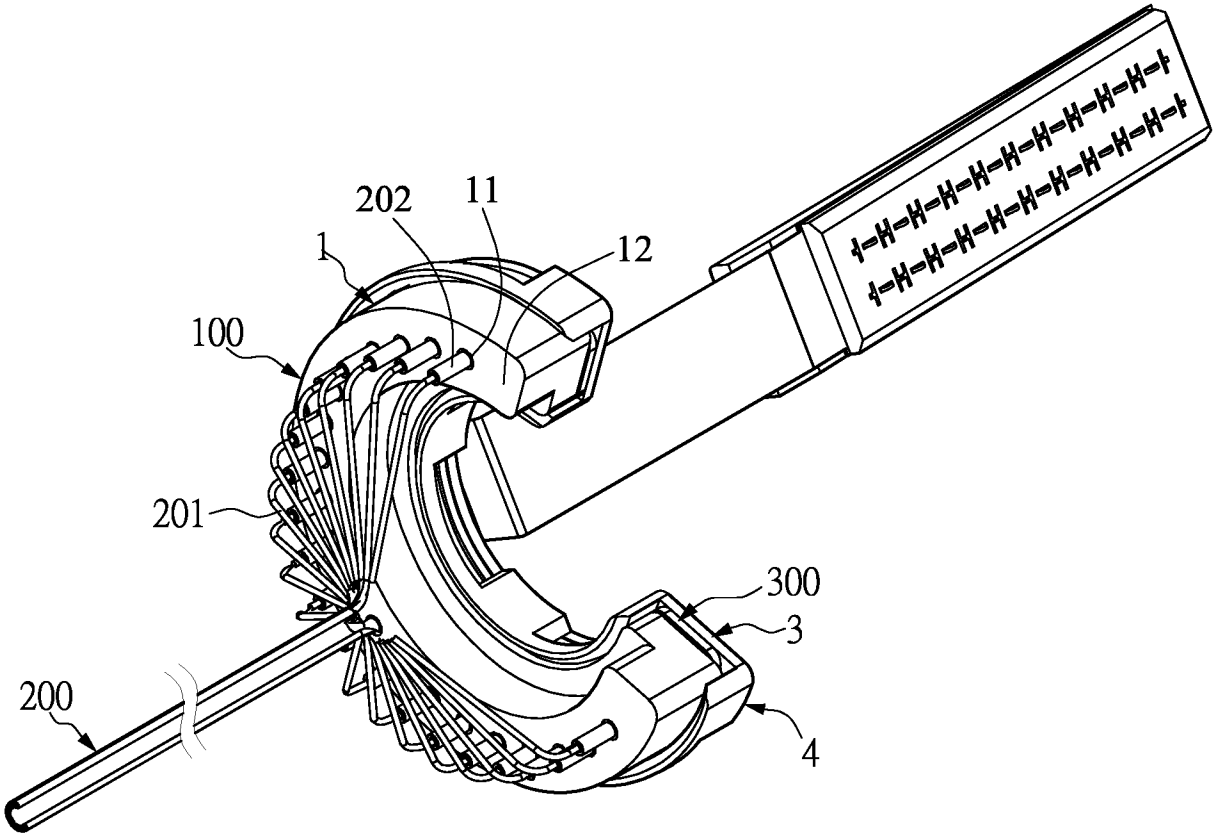
FIG. 12 is a perspective view of the spring connector in still another configuration according to the present disclosure.

Reference is next made to FIG. 11 and FIG. 12, which show the spring connectors 100 in other configurations. Specifically, the insulating case 1 includes a plurality of cable slots 11 spaced apart from each other, and each of the cable slots 11 can be a square hole, a rectangular hole, or a circular hole. The cable slots 11 are formed in the first end surface 12 along the radial direction so as to be respectively in spatial communication with the terminal slots 16 (as shown in FIG. 6). Each of the cables 201 has a connecting end portion 202 that is in a sheet shape or a pin shape. Moreover, the connecting end portion 202 of the cables 201 are respectively disposed in the cable slots 11 of the insulating case 1 and are respectively arranged in the gaps 211 of the contacting portions 21 of the spring terminals 2, and each of the connecting end portions 202 is sandwiched by the corresponding contacting portion 21 in a four-point connection, so that the spring terminals 2 are electrically connected to the cables 202, respectively.

Second Embodiment

Referring to FIG. 7 to FIG. 10, a second embodiment of the present disclosure provides a first connecting device 400 and a second connecting device 500, which are a plug connecting device and a socket connecting device cooperated with the plug connecting device.

Figure 9:
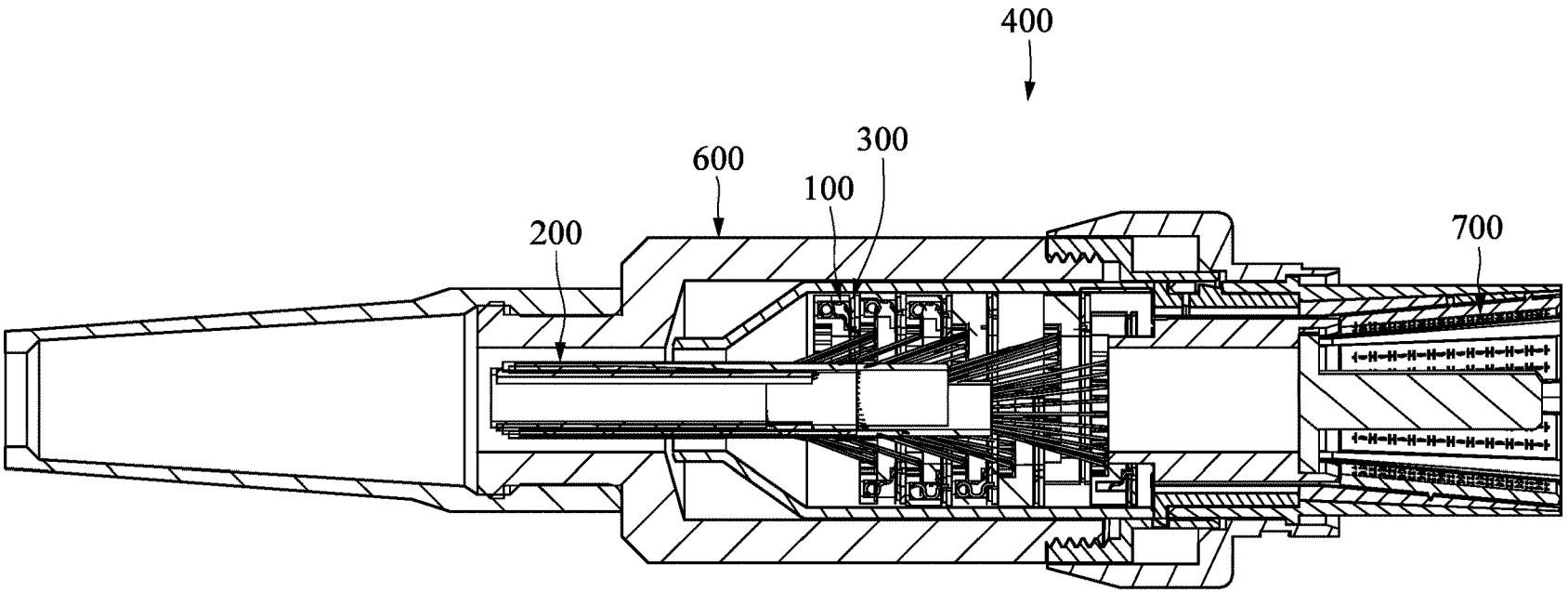
FIG. 9 is a cross-sectional view of the first connecting device according to the second embodiment of the present disclosure.

As shown in FIG. 9, the first connecting device 400 includes a first housing 600, a plurality of spring connectors 100, a first electrical connector 700, a plurality of cable assemblies 200, and a plurality of circuit boards 300. The spring connectors 100 are disposed in the first housing 600 and are stacked together. The circuit boards 300 and the first electrical connector 700 are disposed in the first housing 600, and are electrically connected to each other, so that the cables 201 of the cable assemblies 200 are electrically connected to the first electrical connector 700 through the spring terminals 2 of the spring connectors 100 and the circuit boards 300 (referring also to FIG. 1 and FIG. 2). In addition, the structure of the first electrical connector 700 can be changed according to design requirements.

Figure 10:
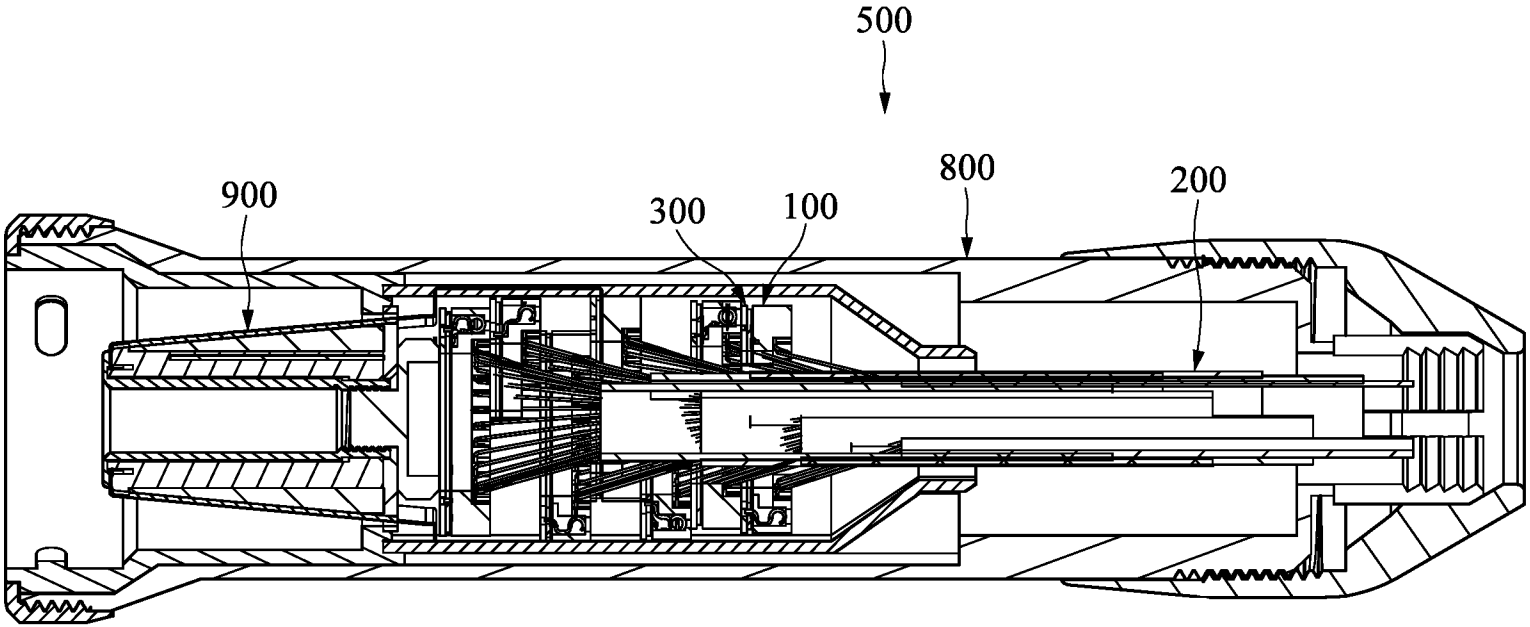
FIG. 10 is a cross-sectional view of the second connecting device according to the second embodiment of the present disclosure.

As shown in FIG. 10, the second connecting device 500 includes a second housing 800, a plurality of spring connectors 100, a second electrical connector 900, a plurality of cable assemblies 200, and a plurality of circuit boards 300. The spring connectors 100 are disposed in the second housing 800 and are stacked together. The circuit boards 300 and the second electrical connector 900 are disposed in the second housing 800, and are electrically connected to each other, so that the cables 201 of the cable assemblies 200 are electrically connected to the second electrical connector 900 through the spring terminals 2 of the spring connectors 100 and the circuit boards 300 (referring also to FIG. 1 and FIG. 2). In addition, the structure of the second electrical connector 900 can be changed according to design requirements. Moreover, when the first connecting device 400 is inserted into the second connecting device 500, the first electrical connector 700 contacts the second electrical connector 900 to establish an electrical connection there-between.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A spring connector for being connected to a cable assembly that includes a plurality of cables each having a connecting end portion, comprising:

an insulating case including a plurality of cable slots spaced apart from each other; and a plurality of spring terminals disposed on the insulating case and each having a contacting portion and at least one tail portion, wherein in each of the spring terminals, the contacting portion is formed in a spiral shape so as to have a gap, and the at least one tail portion is connected to the contacting portion; and the contacting portions of the spring terminals are respectively disposed in the cable slots; and wherein when the connecting end portions of the cables are respectively disposed in the cable slots of the insulating case, the connecting end portions of the cables are respectively arranged in the gaps of the contacting portions of the spring terminals, and each of the connecting end portions is sandwiched by the corresponding contacting portion in a four-point connection, so that the spring terminals are electrically connected to the cables, respectively.

2. The spring connector according to claim 1, wherein the insulating case includes a first end surface, a second end surface, an inner periphery surface, and an outer periphery surface, the first end surface and the second end surface are respectively arranged on two opposite surfaces of the insulating case, and the inner periphery surface and the outer periphery surface are respectively located at an inner side and an outer side of the insulating case; and each of the cable slots is recessed in the first end surface, the inner periphery surface, and the outer periphery surface of the insulating case along a radial direction of the insulating case.

3. The spring connector according to claim 1, wherein the insulating case is C-shaped.

4. The spring connector according to claim 1, wherein the tail portions of the spring terminals are configured to electrically connect to a circuit board.

5. The spring connector according to claim 4, further comprising a cover and a supporting plate, wherein the insulating case includes a plurality of terminal slots that are spaced apart from each other and that are respectively in spatial communication with the cable slots, the spring terminals are respectively disposed in the terminal slots, the cover is disposed on the insulating case to cover the terminal slots, the cover and the insulating case are configured to sandwich the circuit board, and the supporting plate is disposed on a surface of the cover that is distant from the insulating case.

6. A connecting device adapted as a plug connecting device or a socket connecting device, comprising:

a housing;

a plurality of spring connectors disposed in the housing and stacked together, wherein each of the spring connectors includes an insulating case and a plurality of spring terminals; in each of the spring connectors, the insulating case includes a plurality of cable slots spaced apart from each other, and the spring terminals are disposed on the insulating case; each of the spring terminals has a contacting portion and at least one tail portion, the contacting portion is formed in a spiral shape so as to have a gap, and the at least one tail portion is connected to the contacting portion; and the contacting portions of the spring terminals are respectively disposed in the cable slots of the insulating case;

an electrical connector disposed in the housing;

a plurality of cable assemblies respectively assembled with the spring connectors and each including a plurality of cables, wherein each of the cables has a connecting end portion; in each of the cable assemblies and the corresponding spring connector, the connecting end portions of the cables are respectively disposed in the cable slots of the insulating case, the connecting end portions of the cables are respectively arranged in the gaps of the contacting portions of the spring terminals, and each of the connecting end portions is sandwiched by the corresponding contacting portion in a four-point connection, so that the spring terminals are electrically connected to the cables, respectively; and a plurality of circuit boards disposed in the housing, wherein the tail portions of the spring connectors are respectively and electrically connected to the circuit boards, and the circuit boards are electrically connected to the electrical connector, so that the cables of the cable assemblies are electrically connected to the electrical connector through the spring terminals of the spring connectors and the circuit boards.

7. The connecting device according to claim 6, wherein in each of the spring connectors, the insulating case includes a first end surface, a second end surface, an inner periphery surface, and an outer periphery surface, the first end surface and the second end surface are respectively arranged on two opposite surfaces of the insulating case, and the inner periphery surface and the outer periphery surface are respectively located at an inner side and an outer side of the insulating case; and each of the cable slots is recessed in the first end surface, the inner periphery surface, and the outer periphery surface of the insulating case along a radial direction of the insulating case.

8. The connecting device according to claim 6, wherein in each of the spring connectors, the insulating case is C-shaped, parts of the cables are in a radial arrangement with respect to a center of circle of the C-shaped insulating case so as to have the same length, and the other parts of the cables pass through the C-shaped insulating case, so that the C-shaped insulating cases of the spring connectors are stacked in one row.

9. The connecting device according to claim 6, wherein each of the circuit boards is a flexible circuit board.

10. The connecting device according to claim 9, wherein each of the spring connectors includes a cover and a supporting plate, and wherein in each of the spring connectors, the insulating case includes a plurality of terminal slots that are spaced apart from each other and that are respectively in spatial communication with the cable slots, the spring terminals are respectively disposed in the terminal slots, the cover is disposed on the insulating case to cover the terminal slots, the cover and the insulating case are configured to sandwich the circuit board, and the supporting plate is disposed on a surface of the cover that is distant from the insulating case.

* * * * *